US008636109B2

(12) United States Patent
Wallace

(10) Patent No.: US 8,636,109 B2
(45) Date of Patent: Jan. 28, 2014

(54) SECURE ADJUSTABLE ROOF RACK

(76) Inventor: Dale M. Wallace, Brunswick, ME (US)

( * ) Notice: Subject to any disclaimer, the term of this patent is extended or adjusted under 35 U.S.C. 154(b) by 0 days.

(21) Appl. No.: 13/454,240

(22) Filed: Apr. 24, 2012

(65) Prior Publication Data

US 2013/0240295 A1 Sep. 19, 2013

Related U.S. Application Data

(60) Provisional application No. 61/611,242, filed on Mar. 15, 2012.

(51) Int. Cl.
*E04G 5/06* (2006.01)

(52) U.S. Cl.
USPC ..... 182/45; 248/237

(58) Field of Classification Search
USPC ..... 182/45, 129; 248/237, 148
See application file for complete search history.

(56) References Cited

U.S. PATENT DOCUMENTS 681,649 A * 8/1901 Chase ..... 182/45
1,006,562 A * 10/1911 Kefover ..... 248/237
1,047,332 A * 12/1912 Tebbetts ..... 248/237
1,299,874 A * 4/1919 Tuttle ..... 248/237
1,871,154 A * 8/1932 Burk ..... 248/237
1,917,809 A * 7/1933 Reimann ..... 248/237
2,848,282 A * 8/1958 Weber ..... 182/121
6,729,101 B2 * 5/2004 Macri ..... 52/749.12
7,036,629 B2 * 5/2006 Nicolaysen ..... 182/45

* cited by examiner

*Primary Examiner* — Katherine Mitchell
*Assistant Examiner* — Daniel Cahn
(74) *Attorney, Agent, or Firm* — Irving M. Kriegsman

(57) ABSTRACT

The invention provides an adjustable roof rack comprising a roof base bracket comprising a lockdown point and two walls defining a channel containing a plurality of transverse adjustment points, a stable upright comprising a beam having a recessed first terminus and a U-shaped second terminus that is a slide protector, and a platform support comprising a beam that is rotatably attached to a terminus of the roof base bracket and to the U-shaped second terminus of the stable upright by pins, wherein the walls of the roof base bracket bear weight from the platform support and the stable upright, and the recessed first terminus engages one of the transverse adjustment points.

2 Claims, 8 Drawing Sheets end view

SECURE ADJUSTABLE ROOF RACK

BACKGROUND OF THE INVENTION

1. Field of the Invention

The invention relates to roofing. The invention also relates to worker comfort and safety.

2. Summary of the Related Art

Roofing requires a worker to stand on a roof, which may have a pitch that is steep or gentle. Standing directly on the roof can be uncomfortable and unsafe, with a risk of sliding off the roof. It can also result in damage to roofing shingles or tiles. It would be safer and more comfortable for a worker to be able to stand on a level, horizontal platform. Due to the variation in the pitch of different roofs, however, providing a level, horizontal platform for more than one roof requires a structure that can be adjusted. Given the weight of workers and roofing materials, such a structure must also be very strong. The structure should also prevent the platform from shifting or sliding off. Finally, it should be of sufficiently light weight to make it easy to install on the roof. The present invention is directed at achieving all of these requirements.

BRIEF SUMMARY OF THE INVENTION

The invention provides a secure, stable and adjustable roof rack for supporting workers and roofing materials on a level, horizontal platform. The roof rack comprises a roof base bracket comprising adjustment points disposed within a weight bearing beam, such that the adjustment points allow the platform to be made level, but also such that the adjustment points are themselves load bearing. The adjustment points engage a recessed terminus of a stable upright which further comprises a slide protector at an opposite terminus, which rotatably engages one end a platform support, which has another end that rotatably engages the roof base bracket. The invention will be further described in the following drawings and detailed description.

DETAILED DESCRIPTION OF THE PREFERRED EMBODIMENTS

The invention provides an adjustable roof rack comprising a roof base bracket comprising a lockdown point and two walls defining a channel containing a plurality of transverse adjustment points, a stable upright comprising a beam having a recessed first terminus and a U-shaped second terminus that is a slide protector, and a platform support comprising a beam that is rotatably attached to a terminus of the roof base bracket and to the U-shaped second terminus of the stable upright by pins, wherein the walls of the roof base bracket bear weight from the platform support and the stable upright, and the recessed first terminus engages one of the transverse adjustment points.

Figure 1:
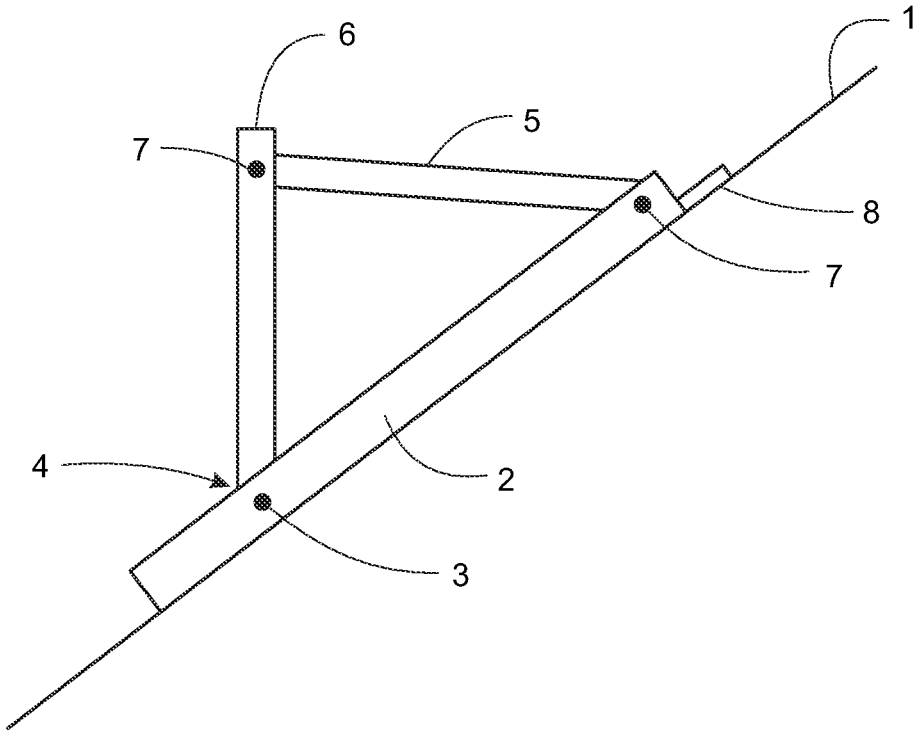
FIG. 1 shows a side view of a roof (1) with a roof rack according to the invention in place. A roof base bracket (2) sits on the surface of the roof. Adjustment points (3) in the roof base bracket engage a terminus of stable upright (4). A detailed view of all of the adjustment points (3) as well as detailed view of the terminus engaging the stable upright (4) is not provided. A platform support (5) rotatably engages another terminus of the stable upright, which extends beyond the platform support to act as a slide protector (6). The platform support also rotatably engages the roof base bracket. Rotatable engagement is provided by metal pins (7). The roof base bracket is secured to the roof by a lock down point (8).

The invention is illustrated by the drawings. FIG. 1 shows a side view of a roof (1) with a roof rack according to the invention in place. A roof base bracket (2) sits on the surface of the roof. Adjustment points in the roof base bracket (3, not visible in this view) engage a terminus of a stable upright (4, also not visible in this view). A platform support (5) rotatably engages another terminus of the stable upright, which extends beyond the platform support to act as a slide protector (6). The platform support also rotatably engages the roof base bracket. Rotatable engagement is provided by metal pins (7). In preferred embodiments, the pins are steel roll pin pivots. Such preferred pivots include those made of double shear strength (17,000 pounds) of Type 420 SS and steel. The roof base bracket is secured to the roof by a lock down point (8). In preferred embodiments, the lock down point is a steel plate welded to a terminus of the roof base bracket and having holes for nailing the roof bracket to the roof.

Figure 2:
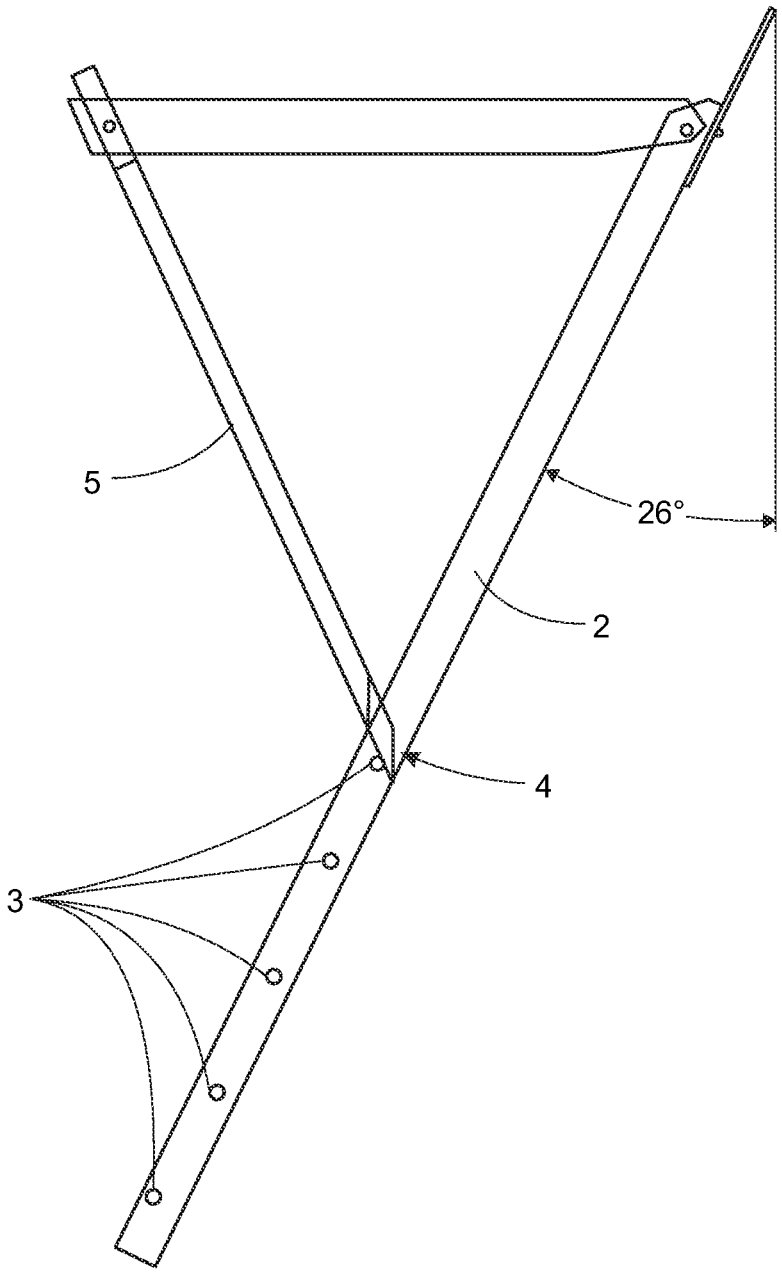
FIG. 2 shows a cut away side view of the roof base bracket (2) and the stable upright. In this view, the adjustment points (3) can be seen, with the terminus of the stable upright (4) engaging one of the adjustment points. The bracket is at an acute angle setting.

FIG. 2 shows a cut away side view of the roof base bracket (2) and the stable upright (5). In this view, the adjustment points (3) can be seen, with the terminus of the stable upright (4) engaging one of the adjustment points. In preferred embodiments, the adjustment points are aluminum pins. 0.5" 5000 series aluminum pins are particularly preferred. The pins pass through holes through the walls and are welded into place. In preferred embodiments, the pins are welded in place with 5356 grade wire.

Figure 3:
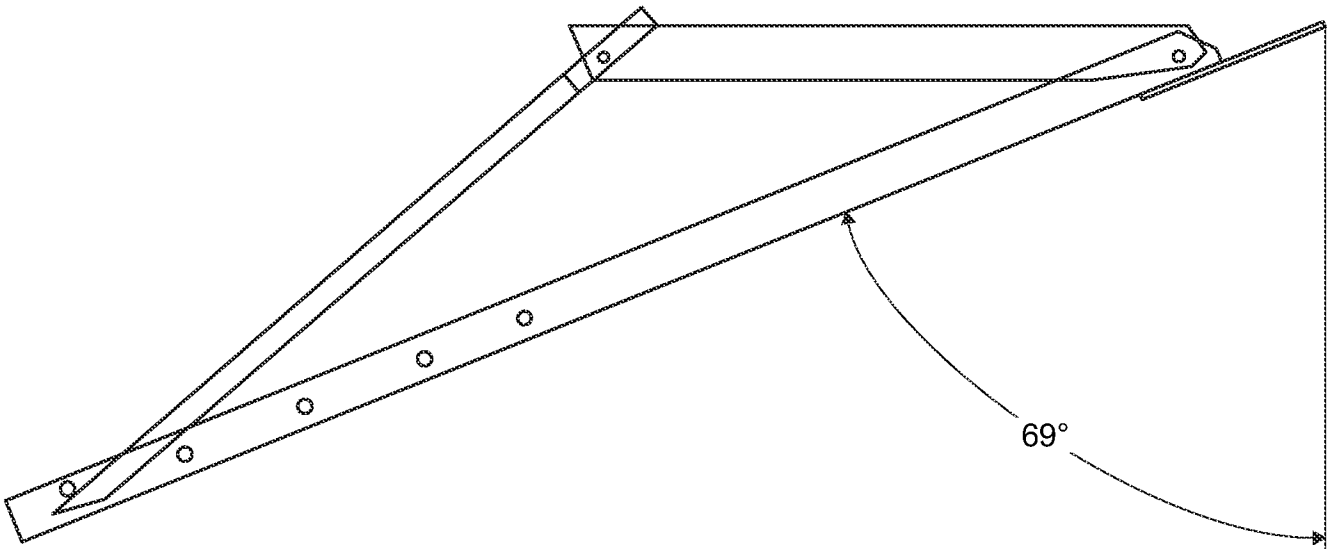
FIG. 3 shows the same bracket at an obtuse angle setting.
Figure 4:
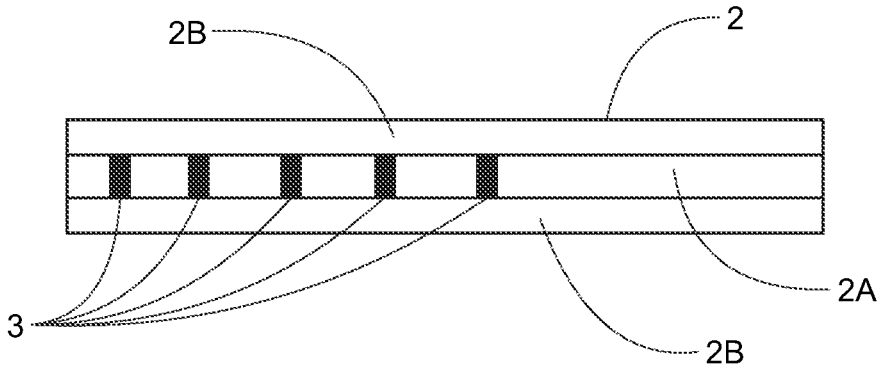
FIG. 4 shows a top view of the roof base bracket (2) which includes a channel (2*a*) between two walls (2*b*) in which the adjustment points (3) can be seen.

FIG. 4 shows a top view of the roof base bracket (2) which includes a channel (2*a*) between two walls (2*b*) in which the adjustment points (3) can be seen. The location of the particular adjustment point used to engage the terminus of the stable upright determines the angle between the roof base bracket and the stable upright, which can be chosen depending on the angle or pitch of the roof, thereby keeping the platform support level. (Compare FIG. 2 and FIG. 3.)

Figure 5:
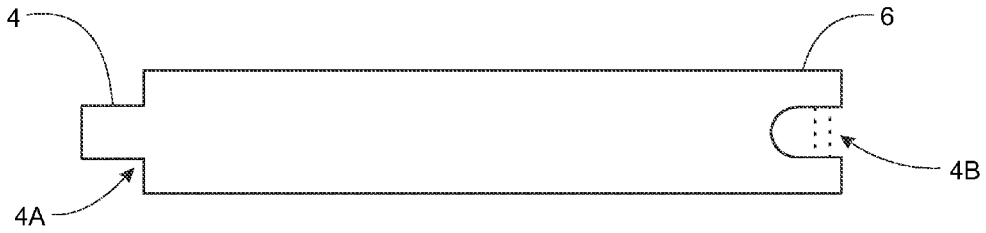
FIG. 5 shows a top view of the stable upright, including the terminus (4) that engages the adjustment points of the roof base bracket and the other terminus (6) which provides the slide protector. A lip (4*a*) can be seen near the terminus, which is recessed to fit within the channel of the roof base bracket. A pin (4*b*, dotted lines) rotatably attaches the stable upright to the platform support.

FIG. 5 shows a top view of the stable upright, including the recessed terminus (4) that engages the adjustment points of the roof base bracket and the other terminus (6) which provides the slide protector. A lip (4*a*) can be seen near the terminus, which is recessed to fit within the channel of the roof base bracket. A pin (4*b*, dotted lines) rotatably attaches the stable upright to the platform support.

Figure 6:
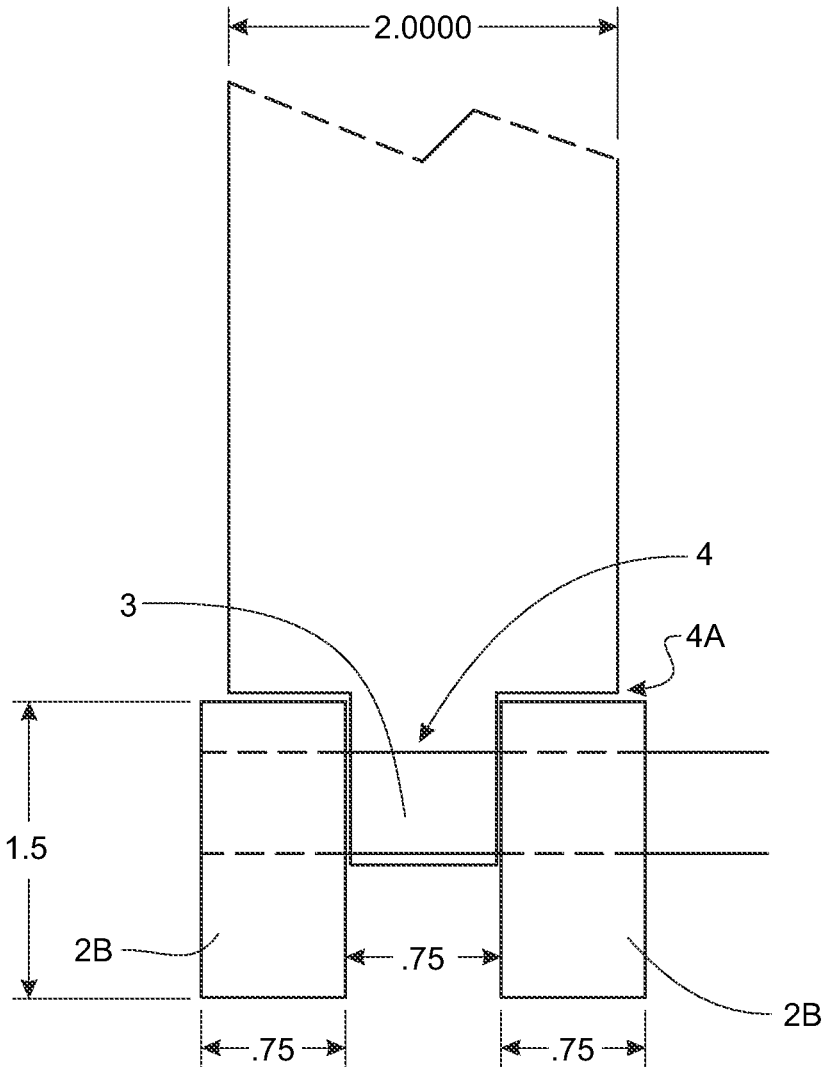
FIG. 6 shows an end view of the roof base bracket engaging the terminus of the stable upright (4), while the lip of the stable upright rests its weight on the walls of the roof base bracket. The walls (2*b*) and the base (2*c*) of the roof base bracket define the channel, in which the adjustment points (3) are disposed.

FIG. 6 shows an end view of the roof base bracket engaging the terminus of the stable upright (4), while the lip of the stable upright (4*a*) rests its weight on the walls of the roof base bracket. The walls (2*b*) of the roof base bracket define the channel, in which the adjustment points (3) are disposed.

Figure 7A:
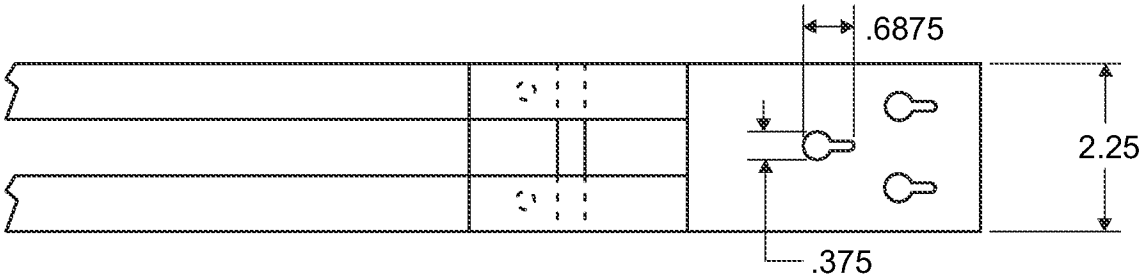
FIG. 7A shows a top view of the lock down point attached to the roof base bracket.
Figure 7B:
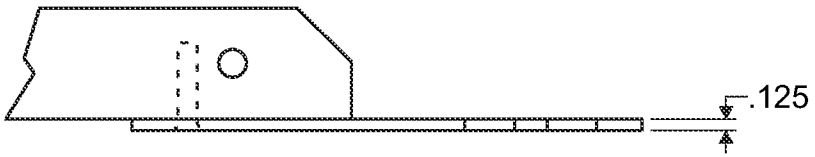
FIG. 7B shows a side view of the lock down point attached to the roof base bracket.
Figure 8:
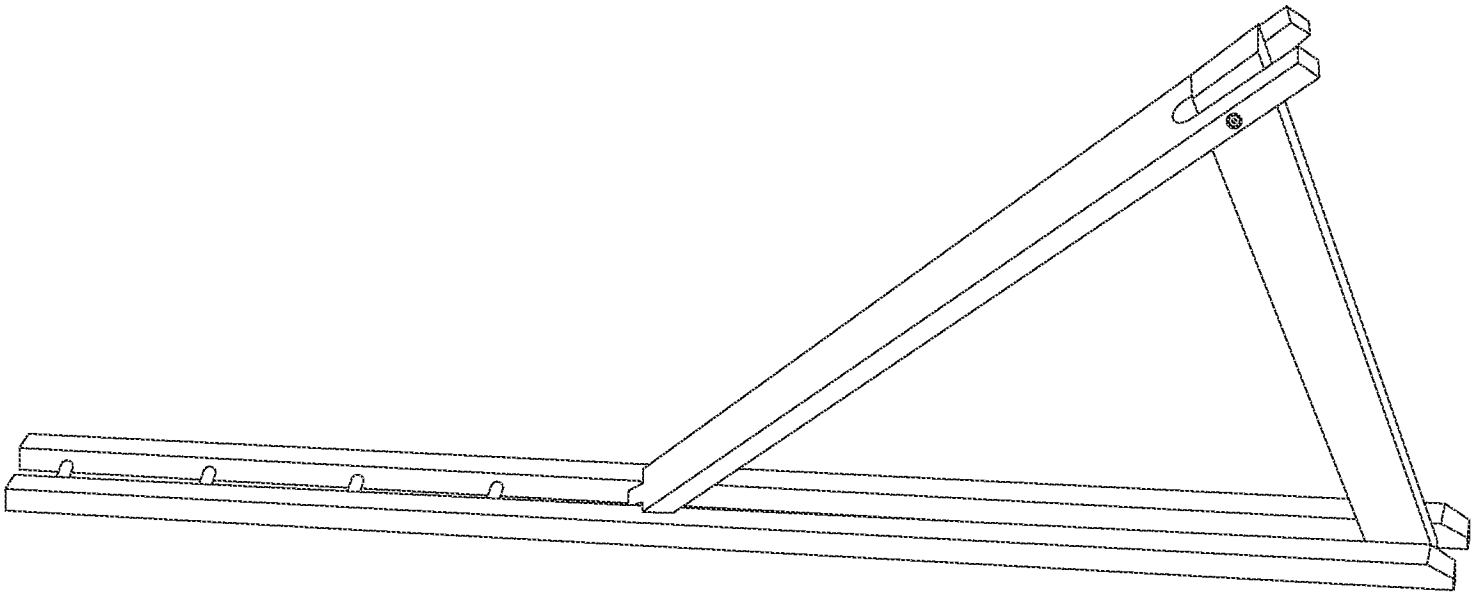
FIG. 8 is a photograph of a roof rack according to the invention, as described in the example.

FIG. 7A shows a top view of the lock down point attached to the roof base bracket. FIG. 7B shows a side view of the lock down point attached to the roof base bracket.

Two brackets as described are spaced apart on the roof and support a platform made of wood or any other suitable material.

The following example of an adjustable roof rack according to the invention is intended to further illustrate the invention and not to limit its scope. In this particular example, the roof base bracket is made from aluminum 6061-t6 and is 47.5" long, 2.25" wide and 1.5" thick and the channel is 1.5 inches deep, i.e, the space between the walls. The walls are held together by the adjustment points. The stable upright is the same material, 24" long and 2" wide and 0.75 inches thick, with a first recessed terminus being 0.75" wide. The lock down point is a 7" by 2.5" A36 grade steel plate screwed and tack welded to the terminus of the roof base bracket and has 3 key holes for being mounted to the roof by nails. The platform support is 24" long by by 2" wide and 0.75' thick and made from the same aluminum. The pins connecting the platform support to the roof base bracket and the stable upright are ⅜" by 2.25" hardened roll pins welded in place with 5356 grade wire. Each adjustment point is a 0.5" aluminum pin passing through holes drilled through the wall and welded in place with 5356 grade wire. The first adjustment point is about 24" from the lock down point, with each additional adjustment point being displaced distally about 5" apart. There are a total of 5 adjustment points.

What is claimed is:

1. An adjustable roof rack consisting of:

(a) a roof base bracket;

(b) a lock down point;

(c) a stable upright; and (d) a platform support;

(e) the roof base bracket being adapted to sit on a surface of a roof, the roof base bracket consisting of two opposed spaced apart walls of aluminum forming a space therebetween, a channel, and a plurality of transverse spaced apart adjustment points, wherein the space between the two walls defines the channel, and wherein each of the transverse adjustment points respectively consist of aluminum pins welded to the two walls;

(f) the lock down point consisting of a steel plate welded to the roof base bracket, the steel plate consisting of three key hole shaped holes to enable the lock down point to be securely mounted onto the roof by nails;

(g) the stable upright consisting of a beam of aluminum having a straight recessed first terminus and a U-shaped second terminus;

(h) the platform support consisting of a beam of aluminum rotatably attached at one end by a steel roll pin to the U-shaped second terminus of the stable upright and rotatably attached at another end by a steel roll pin to the roof base bracket;

(i) wherein, when the adjustable roof rack is in use on a roof, the straight recessed first terminus of the stable upright will extend into the channel and abut up against one of the plurality of adjustment points on the roof base bracket depending on a pitch of the roof and wherein, when the adjustable roof rack is in use on a roof, the walls of the roof base bracket bear weight from the platform support and the stable upright;

(j) wherein the roof base bracket is 47.5 inches long, the stable upright is 24 inches long and the platform support is 24 inches long.

2. The adjustable roof rack of claim 1, wherein each said roll pin is respectively made of double shear strength of 420 SS and steel.

* * * * *